United States Patent [19]

Tinnes et al.

[11] 4,269,399

[45] May 26, 1981

[54] METALLURGICAL FURNACE

[75] Inventors: Bernhard Tinnes, Zollikerberg; Rainer Baumann, Egg; Bernhard Dür, Oetwil am See, all of Switzerland

[73] Assignee: Metacon AG, Zurich, Switzerland

[21] Appl. No.: 145,876

[22] Filed: May 1, 1980

[30] Foreign Application Priority Data

May 7, 1979 [DE] Fed. Rep. of Germany ..... 2918333

[51] Int. Cl.[3] ..... C21C 5/42

[52] U.S. Cl. ..... 266/236

[58] Field of Search ..... 266/236

[56] References Cited

U.S. PATENT DOCUMENTS

| | | | |
|---|---|---|---|
| 3,581,948 | 6/1971 | Detalle | 266/236 |
| 3,773,226 | 11/1973 | Kutzer | 266/236 |
| 3,918,613 | 11/1978 | Shapiand | 266/236 |
| 4,093,452 | 6/1978 | Spenceley | 75/60 |
| 4,131,219 | 12/1978 | Hind | 266/236 |

*Primary Examiner*—P. D. Rosenberg

*Attorney, Agent, or Firm*—Cushman, Darby & Cushman

[57] ABSTRACT

A metallurgical furnace with a discharge chute has a slide closure between the outlet of the furnace and the chute. The chute is preferably detachably secured to the slide closure, on movable parts thereof and can be pivotally supported thereon.

7 Claims, 3 Drawing Figures

METALLURGICAL FURNACE

DESCRIPTION

The invention relates to a metallurgical furnace having a discharge chute.

In metallurgical furnaces it is customary to use discharge chutes when the ladle which is to be filled cannot be brought directly up to the furnace. The discharge chute then bridges the gap between the end of the tapping channel and the filling position of the ladle. Moreover, proposals have been made for branched discharge chutes for the purpose of distributing the contents of the furnace between two ladles. Apart from persistent inadequacies of such chutes, however, the distribution of the molten metal between two ladles is in many cases not sufficient to empty the furnace, since there are limits to the size of ladles, for example for reasons of construction.

According to the present invention there is provided a metallurgical furnace having a discharge chute fastened thereto, and having a slide closure disposed between the discharge chute and the furnace.

With the invention there is provided a furnace which permits the distribution of its contents to a plurality of ladles, while retaining the bridging function of the discharge chute. In this arrangement the slide closure enables the discharge chute to be used intermittently and makes it possible for the contents of the furnace to be distributed to any desired number of ladles one after the other, the tapping channel being closed while the ladle is being changed. The slide closure also makes it possible to prevent slag from passing into the last ladle when the furnace is completely emptied.

In a preferred embodiment of the invention the discharge chute is detachably fastened to the slide closure, and such slide closure is in the form of a constructional unit which can be removed from the furnace as a complete unit.

In other preferred embodiments of the invention, the discharge chute is supported on movable parts of the slide closure.

A further preferred feature is that the slide closure, which is disposed in an upright position, should have a sliding guide member which is inserted between a slide and a lifting drive therefor, and on which the discharge chute, which in the discharge direction is frictionally connected to the slide, is pivotally supported.

The invention will be more clearly understood from the following description which is given by way of example only with reference to the accompanying drawings, in which.

Figures 1, 2:
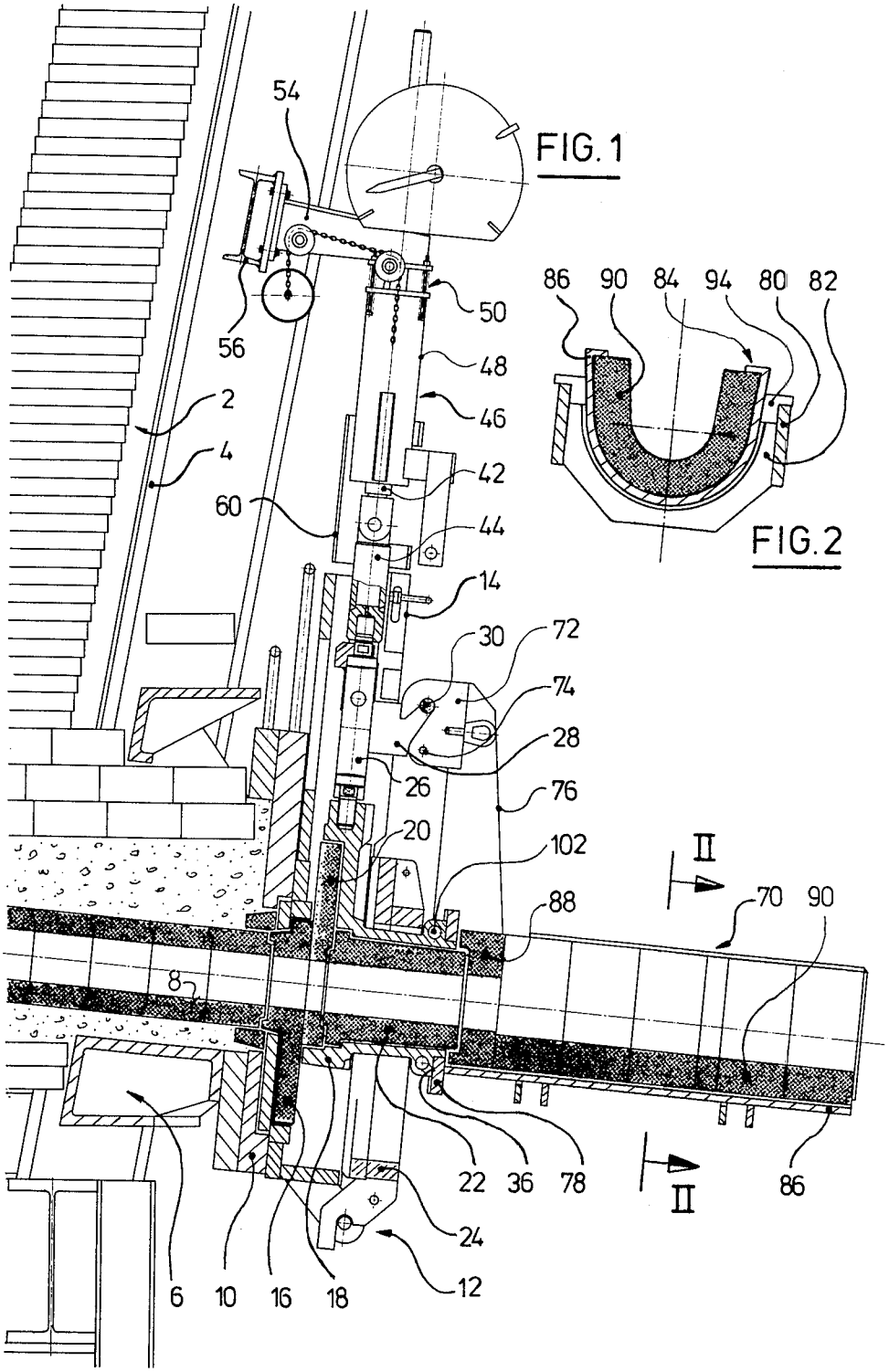
FIG. 1 is a vertical section through a slide closure attached to a furnace having a discharge chute, in accordance with the invention.
FIG. 2 is a section on the line II—II in FIG. 1.

In the drawing, 2 designates generally a furnace, which comprises a framework 4, a tapping connection 6, and a tapping channel 8 extending therein. With the aid of a baseplate 10 fastened to the end face of the tapping connection 6, a closure unit 12 of a slide closure is detachably fastened to the said connection 6, for example by means of stay bolts and wedges. The closure unit comprises a slide housing 14 which contains a refractory bottom plate 16 and also a slide 18 adapted to be displaced in the slide housing parallel to the bottom plate and in turn containing a refractory slide plate 20, which cooperates with the bottom plate, and a refractory discharge discharge sleeve 22. A housing cover 24 presses the slide plate 20 against the bottom plate 16 via the slide 18. The slide housing 14 contains, in line with the slide 18, a sliding guide member 26 which is connected to the slide 18 and which is displaceable in guide slots (not shown) in the slide housing 14. At its end remote from the slide 18 the sliding guide member 26 is detachably joined to a coupling member 44. The coupling member 44 is fastened to a piston rod 42 of a cylinder and piston unit 46 forming a lifting drive.

At its end remote from the slide housing 44 the cylinder 48 of the unit 46 is fastened to a bracket 54 by means of a flexible supporting element 50, the latter permitting movements of the cylinder and piston unit 46 in the axial direction and also, although only to a slight extent, deflection in all directions of the said unit relative to the bracket 54.

The bracket 54 is fastened rigidly to the furnace framework 4 by means of a cross-member 56. In order to enable the reaction forces produced on the operation of the slide by the cylinder and piston unit to be taken direct, the cylinder 48 is connected frictionally but detachably to the slide housing 14 via a connection member given the general reference 60.

On a forked arm 28, which extends out of the slide housing 14 on the side remote from the furnace, the sliding guide member 26 carries a supporting pin 30 whose axis extends parallel to the plane of the closure. A hook-shaped part 72 of a discharge chute given the general reference 70 engages over the supporting pin 30, while a securing pin 74 on the hook-shaped part 72 engages under a cam portion 32 (FIG. 3) on the lower side of the arm 28. A connection flange 78 is rigidly joined to the hook-shaped part 72 by means of two arms 76. In addition, on the arms 76 are fastened two parallel supports 80 which are connected to the connection flange 78 and are joined together by two roughly U-shaped connecting ribs 82 spaced apart from one another. In the bed formed by the supports 80 and the connecting ribs 82 a chute unit is disposed. The chute unit 84 comprises U-shaped chute bricks 90 held together and supported by a sheet metal casing 86, together with an annular refractory connecting brick 88. The sheet metal casing 86, which is reinforced by two ribs 92, is supported by means of four laterally projecting claws 94 on the supports 80 and joined to the latter by screw bolts 96.

While the annular connecting brick 88 engages over the discharge sleeve 22 of the closure unit 12 and is sealingly connected by means of mortar, the connection flange 78 engages over a collar 34 on the movable slide 18 and lies against a shoulder 36. On the connection flange 78 are provided fastening lugs 98 provided with slots 100 extending parallel to the plane of the flange. Clamp bolts 102 passing through the slots 100 engage in bores 38 in the shoulder 36.

As can be seen from the description given above, the discharge chute is fastened as a whole on movable parts of the slide closure, namely on the one hand on the sliding guide member 26 and on the other hand on the movable slide 18. The discharge chute accordingly participates in the movements of the movable slide part in the opening or closing direction when the slide closure is operated. The weight of the discharge chute is primarily transmitted to the sliding guide member 26 through the suspension on the arm 28, so that the forces acting on the movable slide part can be kept low. The discharge chute can be very simply disconnected from the furnace and from the closure unit 12, for which purpose the clamp bolts are first unscrewed and removed from the bores 38. The discharge chute can then be swung by means of a crane into the position shown in FIG. 3, in which the securing pin 74 clears the cam 32 on the lower side of the arm 28, whereupon the hook-shaped member is brought out of engagement with the supporting pin 30. For the renewal of the refractory bricks of the discharge chute the chute unit 84 can be lifted as a whole out of the bed formed by the supports 80 and the ribs 82 after the screw bolts 96 have been removed.

Figure 3:
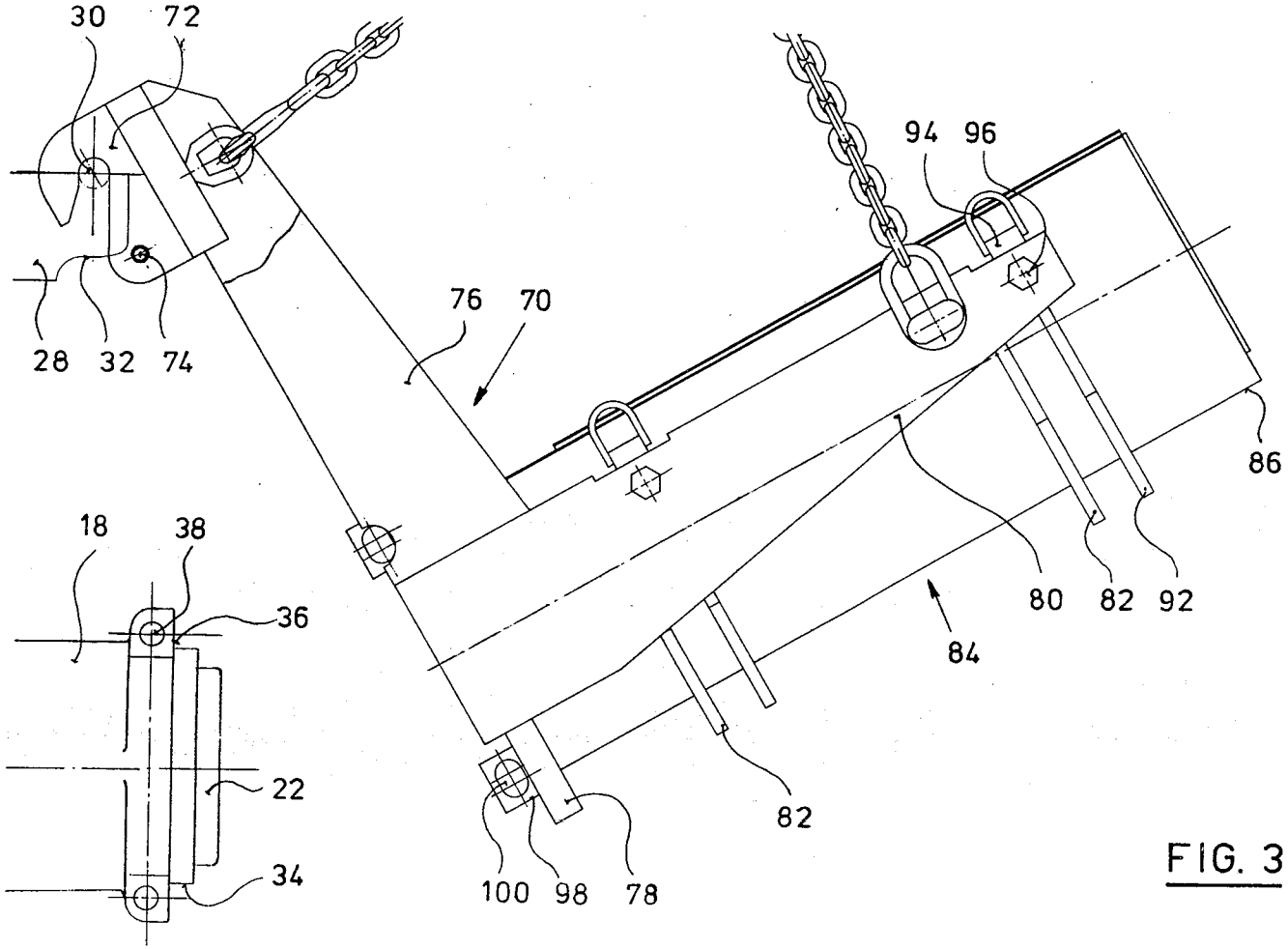
FIG. 3 is a side view of the chute after it has been swung up.

When the discharge chute is being mounted on the slide closure, the position of the chute is secured in the vertical direction as soon as the securing pin 74 comes into engagement with the cam 32 after the hook-shaped part 72 has been engaged and the chute has been swung out of the position shown in FIG. 3, in the clockwise direction. The slots 100 enable the clamp bolts 102 to be inserted into the bores 38 and to be tightened, whereby the connection flange 78 is pressed against the shoulder 36 without vertical forces acting on the shoulder.

In the example of embodiment illustrated the discharge chute is, in the portion formed by the U-shaped chute bricks 90, given a cross-sectional shape and area constant over the entire length. It may however be expedient to widen the inside cross-section of the chute in the direction of flow or increasingly to enclose a constant cross-section.

We claim:

1. In a metallurgical furnace having a side tapping outlet, the combination comprising:

a slide closure for the outlet including a discharge sleeve; and a chute for bridging the gap between the furnace and a ladle and positioned to receive molten metal from said sleeve.

2. A furnace as claimed in claim 1, wherein said chute is secured to said slide closure.

3. A furnace as claimed in claim 2 comprising movable parts in said slide closure, said chute being secured to said movable parts for movement therewith.

4. A furnace as claimed in claim 3, wherein said slide closure is disposed in an upright orientation and said slide closure comprises a slide, a lifting drive and a sliding guide member interconnecting said slide and lifting drive and wherein said chute is pivotally supported on said sliding guide member and frictionally connected with said slide.

5. A furnace as claimed in claim 4, said chute comprising, a supporting bed, a sheet metal casing and refractory bricks, said casing and bricks forming a unit detachably located in said bed.

6. A furnace as claimed in claim 5 further comprising a connection flange on said supporting bed and detachably fastened to said slide, and arms connecting said sliding guide member to said bed.

7. A furnace as claimed in claim 1 and wherein the periphery of the interior wall surface of said chute increases in the direction of flow.

* * * * *